US006169971B1

(12) United States Patent
Bhattacharya

(10) Patent No.: US 6,169,971 B1
(45) Date of Patent: Jan. 2, 2001

(54) METHOD TO SUPPRESS NOISE IN DIGITAL VOICE PROCESSING

(75) Inventor: Bhaskar Bhattacharya, Port Coquitlam (CA)

(73) Assignee: Glenayre Electronics, Inc., Charlotte, NC (US)

( * ) Notice: Under 35 U.S.C. 154(b), the term of this patent shall be extended for 0 days.

(21) Appl. No.: 08/984,175

(22) Filed: Dec. 3, 1997

(51) Int. Cl.[7] ..... G10L 21/02
(52) U.S. Cl. ..... 704/225; 704/226; 704/233
(58) Field of Search ..... 704/225, 226, 704/233; 381/68.4, 57, 94.1, 94.9, 104, 107, 108

(56) References Cited

U.S. PATENT DOCUMENTS

| | | | | |
|---|---|---|---|---|
| 3,849,779 | * | 11/1974 | Boyd | 342/77 |
| 4,028,496 | * | 6/1977 | LaMarche et al. | 704/233 |
| 4,178,552 | | 12/1979 | Amazawa et al. . | |
| 4,216,430 | | 8/1980 | Amazawa et al. . | |
| 4,461,025 | | 7/1984 | Franklin . | |
| 4,628,529 | | 12/1986 | Borth et al. . | |
| 4,630,305 | | 12/1986 | Borth et al. . | |
| 4,747,143 | * | 5/1988 | Kroeger et al. | 704/225 |
| 4,771,472 | | 9/1988 | Williams, III et al. . | |
| 4,847,897 | * | 7/1989 | Means | 379/390 |
| 4,979,214 | * | 12/1990 | Hamilton | 704/233 |
| 5,144,675 | | 9/1992 | Killion et al. . | |
| 5,293,588 | * | 3/1994 | Satoh et al. | 704/233 |
| 5,329,243 | | 7/1994 | Tay . | |
| 5,369,445 | | 11/1994 | Harford . | |
| 5,459,814 | | 10/1995 | Gupta et al. . | |
| 5,533,133 | | 7/1996 | Lamkin et al. . | |
| 5,727,072 | * | 3/1998 | Raman | 704/226 X |

* cited by examiner

*Primary Examiner*—David R. Hudspeth
*Assistant Examiner*—Abul K. Azad
(74) *Attorney, Agent, or Firm*—Christensen O'Connor Johnson & Kindness PLLC

(57) ABSTRACT

A method of suppressing noise in an input signal having voice components and noise components is provided. The method is an automatic gain control (20) implemented preferably in software. The noise components and the voice components are identified by a noise detection routine (300). The input signal, having an energy level, is provided for amplifying the input signal when the voice components are detected. The input signal is amplified by a gain value proportional to the energy level of the input signal. A bias signal, having an energy level, is provided for amplifying the input signal when the noise components are detected. The input signal is amplified by a gain value proportional to the energy level of the bias signal.

10 Claims, 4 Drawing Sheets

METHOD TO SUPPRESS NOISE IN DIGITAL VOICE PROCESSING

FIELD OF THE INVENTION

This invention relates generally to methods for processing speech and, more particularly, to methods for suppressing background noise in digital voice signals.

BACKGROUND OF THE INVENTION

Voice processing technologies often include the use of a conventional automatic gain control (AGC). Input signals representative of voice information are applied to the AGC. Typically, the input signals will reflect varying speech patterns. For example, an input signal can include voice information associated with relatively loud as well as relatively soft speech. The AGC selectively amplifies the input signal. Generally, the AGC provides a relatively low gain for portions of the input signal that have high energy levels. The AGC provides a relatively high gain for portions of the input signal that have low energy levels. A primary purpose of the AGC is to control the amplification of the input signal so that soft speech is sufficiently amplified for a particular voice processing application and loud speech is attenuated to avoid overloading the processing circuitry.

The amplification provided by the AGC depends on many factors, including the nature of the input signal as well as a decay time constant provided for the AGC. An input signal will typically have both noise signal components along with voice signal components. Usually, noise components are identified by their relatively low energy levels, while voice components are identified by their relatively high energy levels. Because noise components have low energy levels, the AGC could undesirably amplify the noise components, unless preventive measures are provided.

To prevent the amplification of background noise, a decay time constant is associated with the operation of the AGC. The decay time constant defines how quickly the AGC will adjust its gain value when it detects a decrease in the energy level of the input signal. The AGC delays increasing its gain upon the detection of a decrease in the input signal's energy level according to the decay time constant. An illustration better describes the function of decay time constants in voice processing applications employing AGCs.

FIG. 1 is a graphical depiction of a voice signal having both voice components and background noise components. The x axis of the graph represents time in seconds. The y axis represents the amplitude of the signal without units. The voice components of the signal are characterized by high amplitude portions of the signal. The signal over interval A is an example of a voice component. The noise components of the signal are characterized by low amplitude portions of the signal. The signal over interval B is an example of a noise component. The signal is provided to a conventional AGC.

As stated above, the AGC variably amplifies an input signal depending on the amplitude of the input signal. To avoid the amplification of noise components, the decay time constant should be larger than the maximum time distance between two subsequent high peak regions of the signal. For example, if the decay time constant has a value equal to the time distance between the peaks of the signal over interval A and interval C, the noise component over interval B will not be amplified. The AGC will appropriately amplify the signal over interval A with a relatively low gain value. As the signal transitions from the voice component over interval A to the noise component over interval B, the decay time constant causes the AGC to maintain the same gain value as when it received the voice component over interval A. Because the gain value is maintained, the noise component over interval B is also amplified with a relatively low gain value. In this way, the noise component over interval B is minimized.

If the decay time constant has too small a value, the noise component over interval B would be undesirably amplified. As stated above, the AGC would provide a relatively small gain value for the voice component over interval A. The AGC would then detect the transition from the relatively high energy levels of the voice component to the relatively low energy levels of the noise component over interval B. If the decay time constant is set, for example, to a value less than the time distance between the two peaks of the signal over interval A and interval C, the AGC would provide a relatively high gain value for the noise component over interval B. The relatively large amplification of the noise component over interval B is the undesirable result of selecting a decay time constant that is too small.

Although the time decay constant should not have too small a value, many disadvantages are posed when the time decay constant is too large. If too large, the decay time constant will prevent the AGC from detecting voice components having varying energy levels. Voice components having varying energy levels represent soft and loud speech. If the signal includes a voice component having a relatively low energy level, and the decay time constant is set to a relatively large value, the AGC would not provide a relatively large gain value to the voice component, as would be optimal. Rather, the AGC would provide to the voice component the same small gain value associated with the voice component having a relatively high energy level. Accordingly, the voice component having a relatively low energy level would not be sufficiently amplified.

For example, assume that the signal includes voice components over intervals D and E, as shown in FIG. 1. The energy level of the signal over interval E is less than the energy level of the signal over interval D. Ideally, the AGC would amplify the signal over interval E more than the signal over interval D. If the decay time constant is chosen to be larger than the time distance between the peaks of the signal over the intervals D and E, the signal over interval E would not be appropriately amplified. Instead, the decay time constant would cause the AGC to apply the same gain value for the signal over interval E as the signal over interval D. As a result, the AGC would fail to provide sufficient amplification for the signal over interval E.

Prior art techniques employing conventional AGCs have attempted to determine optimal values for the time decay constant to avoid the aforementioned problems. However, the determination of the time decay constant involves estimating the time distance between two peaks of successive voice components. Diversity in speech patterns has further complicated the estimation of this time distance and thus the optimal values for time decay constants. Too often, the estimate of the time decay constant is unacceptably imprecise, increasing the presence of noise and attendantly decreasing voice quality.

Because the estimation of time decay constants in AGCs fails to reliably provide noise reduction and voice amplification, techniques to better distinguish noise components from voice components have been proposed. Some of these techniques are commonly referred to as voice activity detection (VAD). One such VAD technique is the zero crossing rate technique. Under the zero crossing rate technique, a voice signal is analyzed to determine what portions thereof cross a zero amplitude line. The zero line separates positive amplitude values of a signal from negative values of the signal. The number of times the signal crosses the zero line in a given time is referred to as the zero crossing rate. Voice components have relatively low zero crossing rates, while noise components have relatively high zero crossing rates. Accordingly, noise components and voice components can often be identified based on their zero crossing rates.

Other popular VAD techniques are used to distinguish voice from noise. One such technique is commonly referred to as the linear prediction technique. Under this technique, linear prediction coefficients (LPC coefficients) are calculated to indicate the presence of voice or noise, depending on the value of the LPC coefficients. Another VAD technique is to determine how quickly or slowly the energy level of the signal changes. Rapidly changing energy levels indicate the presence of voice components, while slowly changing energy levels indicate the presence of noise components.

All of the VAD techniques described above can sometimes distinguish between noise and voice. However, each technique fails to consistently and reliably distinguish between noise and voice. This failure is caused by overlapping regions where no conclusive distinction between noise and voice is possible. In overlapping regions, noise components and voice components may both be present. For example, digital voice processing applications employing zero crossing rate techniques define a range of values over which voice components are identified. Similarly, a range of values is defined over which noise components are identified. These two ranges are not mutually exclusive. Rather, they overlap. In the overlapping region, the zero crossing rate technique cannot, definitively identify a portion of a signal as either voice or noise. The uncertainty caused by such overlapping regions, in zero crossing rate technologies as well as other VAD techniques, has plagued digital voice processing applications.

The inability of prior art techniques to reliably distinguish between noise components and voice components is especially grave in digital voice processing applications requiring the total removal of noise components for optimal performance. In these applications, once noise components are identified, they are completely suppressed and removed from the remaining voice signal. Because prior art techniques fail to reliably identify noise components when they exist, the noise is frequently never removed. Alternatively, voice components are sometimes mistakenly identified as noise components, and consequently removed. The mistaken elimination of voice components causes degradation in the quality of the voice signal. In many instances, the degradation is sufficient to drastically impair the intelligibility of the voice signal.

Accordingly, there is a need for a new method to process speech that does not require the removal of components in voice signals and the associated mistaken elimination of voice components.

SUMMARY OF THE INVENTION

A method of suppressing noise in an input signal having voice components and noise components is provided. The method is an automatic gain control preferably implemented in software. The noise components and the voice components are identified by a noise detection routine. The input signal, having an energy level, is provided for amplifying the input signal when the voice components are detected. The input signal is amplified by a gain value inversely proportional to the energy level of the input signal. A bias signal, having an energy level, is provided for amplifying the input signal when the noise components are detected. The input signal is amplified by a gain value inversely proportional to the energy level of the bias signal.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
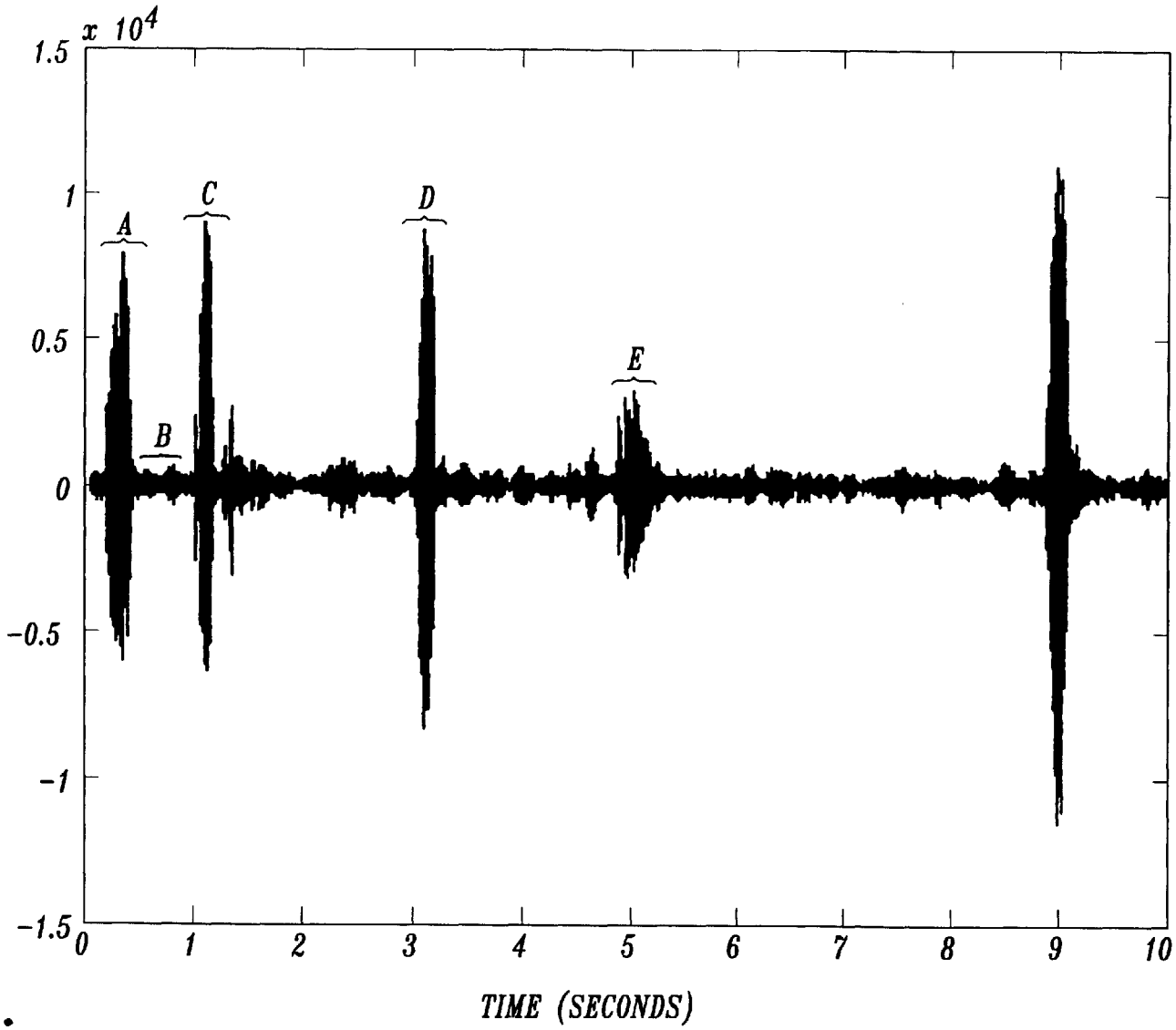
Fig. 1. (PRIOR ART)
FIG. 1 is a diagram of a voice signal subject to a voice activity detection technique of the prior art.
Figure 2:
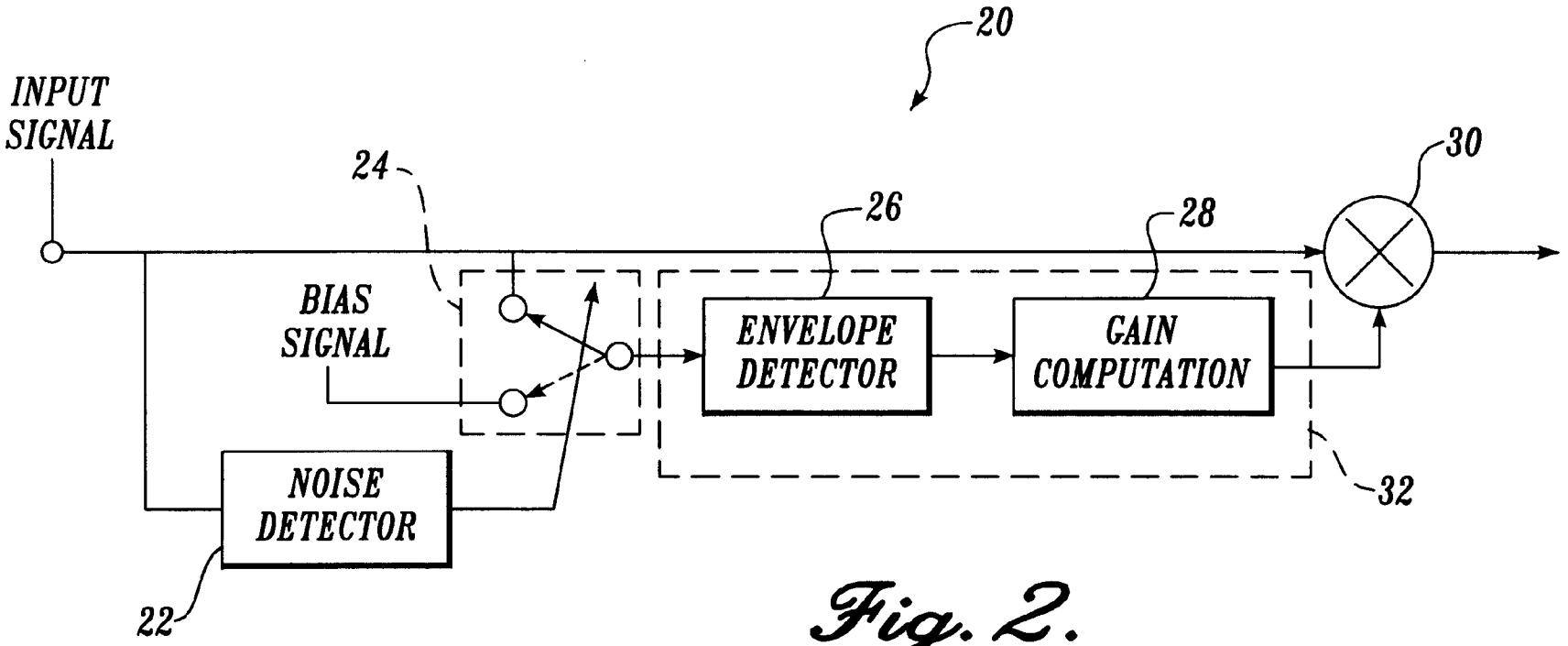
FIG. 2 is a functional block diagram of an automatic gain control in accordance with the present invention.

FIG. 2 illustrates an automatic gain control (AGC) 20 in accordance with the method of the present invention. The AGC 20 is preferably implemented as software in a voice compression board of a paging terminal. The AGC 20 can alternatively be implemented by digital or analog circuits. The invention also has utility in other environments including, for example, cellular telephone and voice mail applications.

The AGC 20 includes a noise detector 22, a switch 24, an envelope detector 26, a gain computation 28, and a multiplier 30. These illustrated blocks of the AGC 20 are distinct functions preferably performed by software. An input signal having both voice signal components and background noise signal components is provided to the AGC 20. The input signal is a digital representation of speech. The AGC 20 processes the input signal to identify voice components and noise components of the input signal and then appropriately amplifies the input signal.

The input signal is provided to both the noise detector 22 and the multiplier 30. As described in more detail below in connection with FIGS. 3A–3B, the noise detector 22 determines whether portions of the input signal are either noise or voice. Based upon this determination, the noise detector 22 causes the switch 24 to toggle between two positions. When the noise detector 22 detects the presence of voice in the input signal, the switch 24 is positioned to provide the input signal to the envelope detector 26. When the noise detector 22 identifies the presence of noise in the input signal, the switch 24 is positioned to provide a bias signal to the envelope detector 26. Preferably, the bias signal has a constant direct current value that represents approximately one-fourth of the maximum amplitude that the input signal can have. The maximum amplitude for typical voice input signals is approximately ±8192. Accordingly, in one embodiment of the invention, the bias signal has a value of approximately 2238.

The envelope detector 26 receives either the input signal or the bias signal. The envelope detector 26 determines the amplitude of the signal. An indication of the amplitude of either the input signal or the bias signal is then provided from the envelope detector 26 to the gain computation 28. The gain computation 28 provides an appropriate gain value to the multiplier 30, depending on the amplitude of the signal. The gain computation 28 provides a gain value that is inversely proportional to the amplitude of the signal. If the amplitude of the signal is relatively high, the gain computation 28 provides a relatively low gain value. If the amplitude of the signal is relatively low, the gain computation 28 provides a relatively high gain value. The input signal is amplified by the gain value at the multiplier 30. The amplified input signal is then transmitted from the AGC 20 for subsequent voice processing according to a particular application.

The AGC 20 provides an innovative technique for suppressing noise components in the input signal. As stated above, upon the detection of noise, the bias signal rather than the input signal is provided to the envelope detector 26. The envelope detector 26 detects the relatively high amplitude of the bias signal and provides the corresponding indication to the gain computation 28. Because the bias signal has a relatively high amplitude, the gain computation 28 in response provides a relatively low gain value to the multiplier 30. Accordingly, the noise of the input signal is amplified at the multiplier 30 by a relatively small gain value. In this way, the noise of the input signal is minimized and suppressed.

Figure 3A:
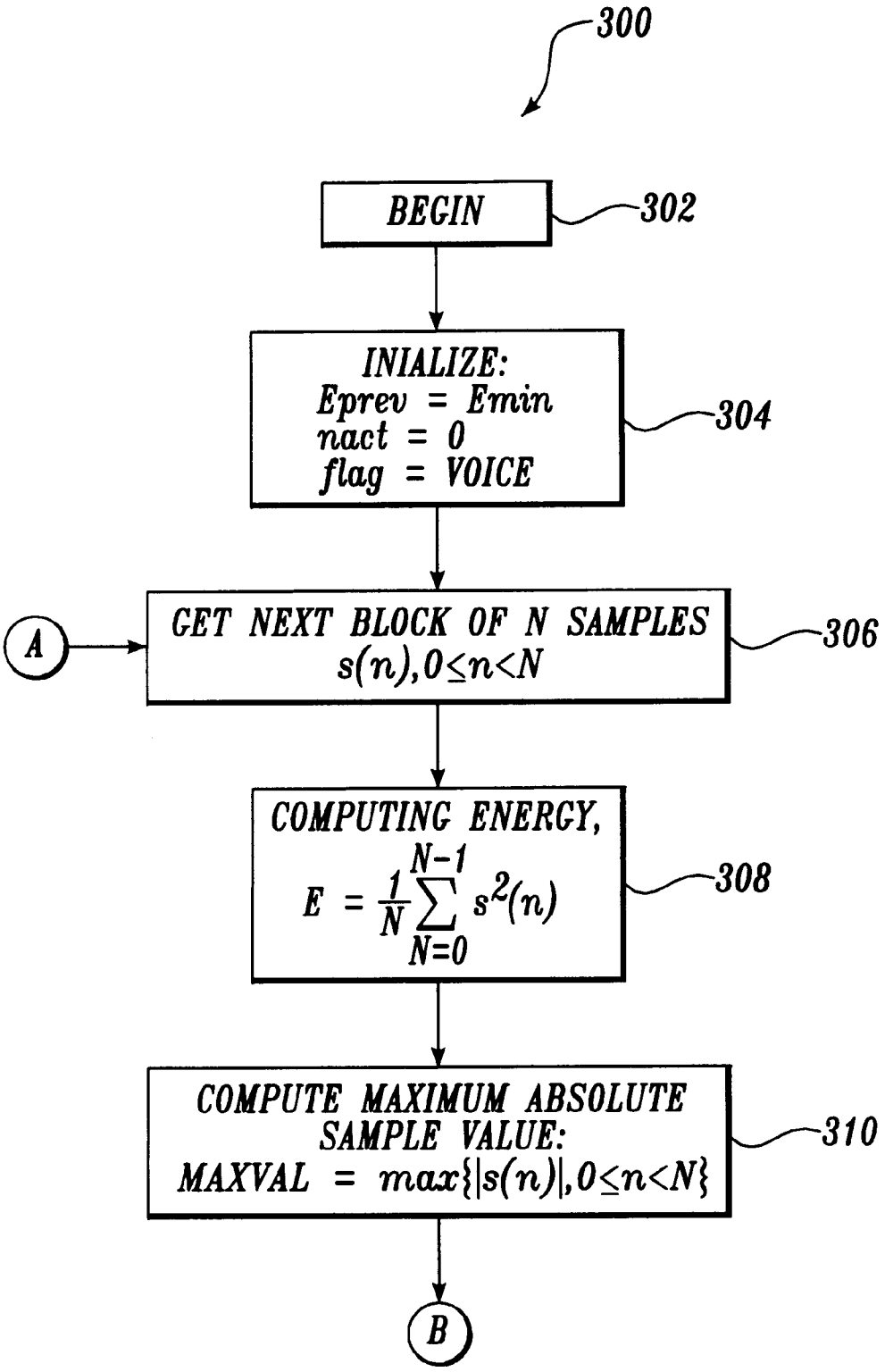
FIGS. 3A–3B are flowcharts illustrating the logic of a noise detector in the automatic gain control of FIG. 2 in accordance with the present invention.
Figure 3B:
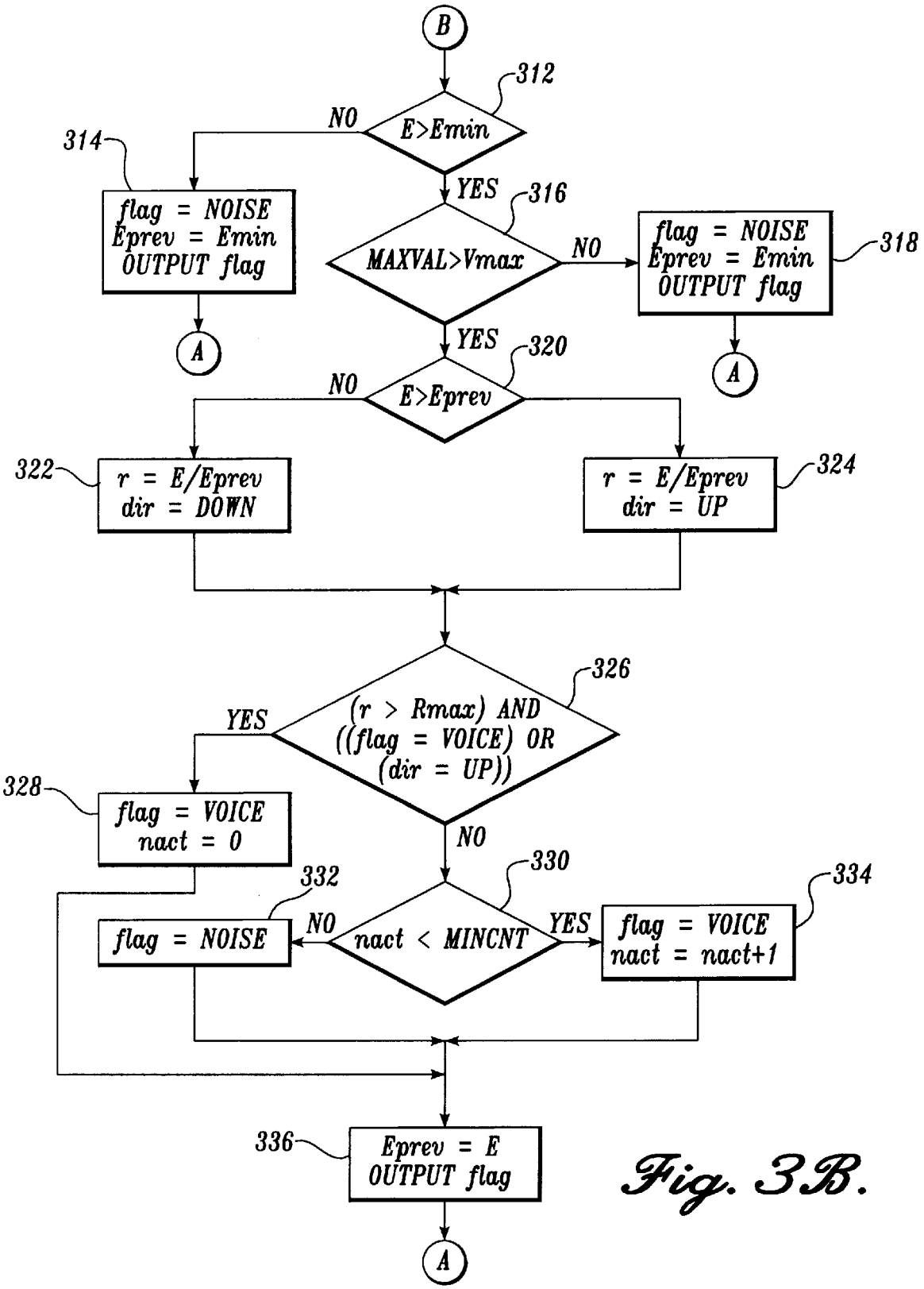

The noise detector 22 plays a vital role in the AGC 20 in accordance with the present invention. The ability of the noise detector 22 to reliably identify noise components in the input signal allows the noise to be suppressed. FIGS. 3A–3B are a flowchart illustrating a logic routine 300 of the noise detector 22. The logic routine 300 involves comparing the energy level of a current block of input signal samples with a prior block of input signal samples. This comparison determines the rate of change in the energy level of the input signals. When the energy level rate of change is relatively fast, the noise detector 22 in essence identifies the relevant portion of the input signal as a voice component. When the energy level rate of change is relatively slow, the noise detector 22 in essence identifies the relevant portion of the input signal as a noise component.

The logic routine 300 includes variables and constants, which are introduced below:

N is a predetermined number of samples that constitute a block of the input signal.

E is an energy level of a current block of N samples.

Eprev is the energy level of the previous block of N samples.

dir is a direction variable indicating whether the energy level of the input signal is increasing or decreasing.

MAXVAL is the maximum absolute sample value of the current block of N samples.

r is the energy ratio of the energy level $E_{prev}$ to the energy level E.

Vmax is a constant, threshold absolute sample value.

Rmax is a constant, threshold energy ratio.

MINCNT is a constant number of blocks to be classified as voice.

nact is the number of consecutive voice blocks.

flag is an indication of the presence of voice or noise.

Emin is a constant, minimum energy level required to classify a block as voice.

The logic routine 300 begins at a block 302 and proceeds to a block 304. At the block 304, variables Eprev, nact, and flag are initialized. Eprev is set equal to Emin. Emin is a constant minimum energy level required for a block of samples to be considered voice. In the preferred embodiment, Emin is equal to approximately 2000, as empirically determined by the invention of the present invention. nact is set equal to zero. nact is a counter for counting consecutive blocks of samples that are classified as voice. The flag is set to VOICE. The flag corresponds to either VOICE or NOISE. When the flag is set to VOICE, the presence of a voice component is indicated. When the flag is set to NOISE, the presence of a noise component is indicated. The logic proceeds from the block 304 to a block 306.

At the block 306, a current block of N samples is acquired from the input signal s(n), where $0 \leqq n \leqq N$. In the preferred embodiment, N has a value of approximately 160 for a sampling rate of 8,000 Hz. Of course, other values of N are possible, depending on the particular application of the present invention. As described in more detail below, the logic routine calculates the average energy of a block of N samples. It will be appreciated that the effect of sudden energy level changes on distinguishing noise from voice depends on the value of N. The logic proceeds from the block 306 to a block 308.

At the block 308, the energy level E of the current block is computed. The energy level E is determined by the equation:

$$E = \frac{1}{N}\sum_{n=0}^{N-1} s^2(n). \tag{1}$$

The logic proceeds from the block 308 to a block 310. At the block 310, a maximum absolute sample value MAXVAL is computed from the current block. The maximum absolute sample value MAXVAL represents the sample of the block having the highest energy level. The logic proceeds from the block 310 to a decision block 312.

At the decision block 312, the logic determines if the energy level E is greater than the minimum energy level Emin. If the result of the decision block312 is negative, the logic proceeds to a block 314. Because the energy level E does not exceed the minimum energy level Emin, the threshold energy level required for a block to qualify as voice, the logic determines that the current block is not voice, but rather noise. Accordingly, the flag is set to NOISE. The energy level Eprev is set to the minimum energy level Emin. The value of the flag is applied to position the switch 24 so that the bias signal is provided to the envelope detector 26. The logic then proceeds from the block 314 to the block 306.

If the result of the decision block 312 is positive, the logic determines that the energy level E is greater than the minimum energy level Emin. This determination indicates that the current block could be a voice component of the input signal. The logic proceeds from the decision block 312 to a decision block 316. At the decision block 316, the logic determines if the maximum absolute sample value MAXVAL is greater than Vmax. Vmax is a constant, threshold value that the maximum absolute sample value MAXVAL must exceed for the current block to qualify as voice. Preferably, the value of Vmax is approximately 200, as empirically determined by the inventor of the present invention. If the result of the decision block 316 is negative, the logic proceeds to a block 318. At the block 318, the logic determines that the current block is noise. Accordingly, the flag is set to NOISE. The energy level Eprev is set equal to the energy level E. The value of the flag is applied to position the switch 24 to the bias signal. The logic proceeds from the block 318 to the block 306.

If the result of the decision block 316 is positive, the logic proceeds to a decision block 320. At the decision block 320, the logic determines if the energy level E is greater than the energy level Eprev. If the result of the decision block 320 is negative, the logic proceeds to a block 322. At the block 322, an energy ratio r is set equal to the energy level Eprev divided by the energy level E. A direction variable dir indicates whether the energy level of the input signal is increasing or decreasing. Because the energy level E is less than or equal to the energy level Eprev, the logic determines that the energy level of the input signal is decreasing. Accordingly, the direction variable dir is set to DOWN. The logic proceeds from the block 322 to a decision block 326.

If the result of the decision block 320 is positive, the logic proceeds to a block 324. At the block 324, the ratio r is set to the energy level E divided by the energy level Eprev. Because the energy level E is greater than the energy level Eprev, the energy level of the input signal is increasing. Accordingly, the direction variable dir is set to UP. The logic proceeds from the block 324 to the decision block 326.

At the decision block 326, the logic determines if: (1) the energy ratio r is greater than a threshold energy ratio Rmax and (2) the flag is set to VOICE or the direction variable dir is set to UP. The threshold energy ratio Rmax is compared to the energy level rate of change between a current block and a previous block of samples. This comparison distinguishes noise from voice. Preferably, Rmax has a value of approximately 2–8, as empirically determined by the inventor of the present invention. The logic classifies the current block as voice only if the energy level rate of change exceeds the threshold energy ratio Rmax and if the previous block was not classified as noise or if the current block has an energy level higher than the energy level of the previous block. If the result of the decision block 326 is positive, the logic proceeds to a block 328. At the block 328, the logic determines that the current block is voice. Accordingly, the flag is set to VOICE. The number of consecutive voice blocks nact is set equal to zero. The logic proceeds from the block 328 to a block 336.

If the result of the decision block 326 is negative, the logic proceeds to a decision block 330. At the decision block 330, the logic determines if the number of consecutive voice blocks nact is less than a constant number of blocks to be classified as voice MINCNT. After a current block has been classified as voice based on the value of the energy ratio r, a predetermined, constant number of subsequent blocks are also classified as voice. Isolated blocks of voice rarely appear in typical speech patterns, if at all. Accordingly, when a current block is classified as voice, the method of the present invention predicts that subsequent blocks immediately following the current block will also be voice. In the preferred embodiment, the constant number of blocks to be classified as voice MINCNT is approximately 40.

If the result of the decision block 330 is negative, the logic determines that the number of consecutive blocks classified as voice are insufficient to classify the blocks as voice. The logic proceeds from the block 330 to a block 332. The logic determines that the current block is noise. The flag is set to NOISE. The logic proceeds from the block 332 to the block 336.

If the result of the decision block 330 is positive, the logic identifies the presence of voice. The number of consecutive blocks identified as voice has met the required threshold, allowing the current block to be classified as voice. The flag is set to VOICE. The number of consecutive voice blocks nact is incremented by 1. The logic proceeds from the block 334 to the block 336. At the block 336, the energy level Eprev is set equal to the energy level E. The value of the flag is applied to appropriately position the switch 24. If the flag is set to NOISE, the bias signal is applied to the envelope detector 26. If the flag is set to VOICE, the input signal is applied to the envelope detector 26. The logic proceeds from the block 336 to the block 306.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of suppressing noise in an input signal having an energy level, the input signal including voice components and noise components, the method comprising the steps of:

(a) detecting the noise components and the voice components as a function of a rate of change of the energy level of the input signal;

(b) providing a bias signal having a constant energy level;

(c) amplifying the input signal by a constant gain value inversely proportional to the energy level of the bias signal when noise components are detected in the input signal and voice components are not detected in the input signal; and (d) amplifying the input signal by a gain value inversely proportional to the energy level of the input signal when the voice components are detected.

2. A method as claimed in claim 1 wherein the step of amplifying the input signal by a constant gain value proportional to the energy level of the bias signal when noise components are detected in the input signal and voice components are not detected in the input signal includes the substeps of:

(a) detecting an envelope of the bias signal; and (b) computing the gain value based on the envelope.

3. A method as claimed in claim 1 wherein the step of detecting the noise components and the voice components includes the substeps of:

(a) obtaining a current block of samples of the input signal;

(b) comparing an energy level E of the current block of samples with a minimum energy level Emin; and (c) classifying the current block as noise when the energy level E is less than or equal to the minimum energy level Emin.

4. A method as claimed in claim 3 wherein the substep of obtaining a current block of samples of the input signal includes the substeps of:

(a) sampling the input signal at approximately 8,000 Hz; and (b) obtaining approximately 160 samples for the current block of samples.

5. A method as claimed in claim 3 wherein the step of detecting the noise components and the voice components further includes the substeps of:

(a) comparing a maximum absolute sample value MAXVAL with a threshold absolute sample value Vmax when the energy level E is greater than the minimum energy level Emin; and (b) classifying the current block as noise when the maximum absolute sample value MAXVAL is less than or equal to the threshold absolute sample value Vmax.

6. A method as claimed in claimed 5 wherein the step of detecting the noise components and the voice components further includes the substep of setting an energy level Eprev equal to the minimum energy level Emin.

7. A method as claimed in claimed 5 wherein the step of detecting the noise components and the voice components further includes the substeps of:

(a) comparing the energy level E with an energy level Eprev when the maximum absolute sample value MAXVAL is greater than the threshold absolute sample value Vmax;

(b) calculating an energy ratio r of the energy level Eprev to the energy level E;

(c) setting a direction variable dir to UP when the energy level of the input signal is increasing;

(d) setting the direction variable dir to DOWN when the energy level of the input signal is decreasing; and (e) classifying the current block as voice when the energy ratio r is greater than a threshold energy ratio Rmax and the current block has not been identified as noise or the direction variable dir is set to UP.

8. A method as claimed in claim 7 wherein the step of detecting the noise components and the voice components further includes the substep of setting a number of consecutive voice blocks nact to zero when the energy ratio r is greater than the threshold energy ratio Rmax and the current block has not been identified as noise or the direction variable dir is set to UP.

9. A method as claimed in claim 7 wherein the step of detecting the noise components and the voice components further includes the substeps of:

(a) comparing a number of consecutive voice blocks nact with a constant number of blocks to be classified as voice MINCNT;

(b) classifying the current block as noise when the number of consecutive voice blocks nact is greater than or equal to the constant number of blocks to be classified as voice MINCNT; and (c) classifying the current block as voice when the number of consecutive voice blocks nact is less than the constant number of blocks to be classified as voice MINCNT.

10. A method as claimed in claim 9 wherein the step of detecting the noise components and the voice components further includes the substep of incrementing the number of consecutive voice blocks nact when the number of consecutive voice blocks nact is less than the constant number of blocks to be classified as voice MINCNT.

* * * * *